United States Patent [19]

Anderson

[11] Patent Number: 4,979,470

[45] Date of Patent: Dec. 25, 1990

[54] SPRING LOADED FEEDER CLOSURE

[76] Inventor: Douglas D. Anderson, Rte. 4, Box 29, Marshall, Minn. 56258

[21] Appl. No.: 419,476

[22] Filed: Oct. 10, 1989

[51] Int. Cl.[5] ..... B65D 43/26

[52] U.S. Cl. ..... 119/51.01; 49/13; 49/404

[58] Field of Search ..... 119/51.01, 192; 49/13, 49/404; 116/303, 285

[56] References Cited

U.S. PATENT DOCUMENTS

| | | | |
|---|---|---|---|
| 610,430 | 9/1893 | Cozine | 49/13 |
| 1,155,189 | 9/1915 | Adams | 119/51.01 |
| 1,796,168 | 3/1931 | Stair | 49/404 |
| 1,916,570 | 7/1933 | Heider | 119/51.01 |
| 2,454,896 | 11/1948 | Traub | 49/13 |
| 2,627,244 | 2/1963 | Herigstad | 116/303 |
| 3,327,677 | 6/1967 | King | 116/303 |
| 3,466,801 | 9/1969 | Bohn | 49/404 |
| 3,733,750 | 5/1973 | Hege | 52/192 |
| 3,837,119 | 9/1974 | Conneally | 49/404 |
| 3,924,558 | 12/1975 | Grazia | 116/303 |
| 3,978,617 | 9/1976 | Evetoff | 49/404 |
| 4,267,936 | 5/1981 | Paulicak | 49/404 |
| 4,471,575 | 9/1984 | Stout | 49/404 |

*Primary Examiner*—Paul J. Hirsch

[57] ABSTRACT

A closure for the upper opening on a bin-type livestock feeder which is operable by the delivery elevator on a supply truck. The closure is slidable relative to the bin and is biased to a closed position by springs engaged between the bin and the closure.

5 Claims, 3 Drawing Sheets

SPRING LOADED FEEDER CLOSURE

BACKGROUND AND SUMMARY OF THE INVENTION

This invention pertains to closing devices adapted to provide for closing the top opening of a bin-type feeder for livestock, and more particularly to such a closure which is slidably operable by exterior means and is spring-biased to a closed position.

Livestock raisers, and particularly hog feeding farmers frequently use large bin-type devices as feeders for their livestock. These feeders are often set in the feed lot in which the livestock are kept, and therefore those are ordinarily filled while they are in the lot.

Filling such feeders is done through a top opening covered by a closure adapted to keep rain, snow or other precipitation away from the contents of the feeder. Such filling is commonly accomplished by use of an auger-type elevator, frequently, by such an elevator mounted on a truck. Oftentimes, a feed dealer with such a truck provides ground and mixed feed to the livestock producer and simply drives the truck onto the producer's yard, extends the elevator over the top of the feeder, removes a cap from the feeder and starts elevating the feed from the truck into the feeder.

The process seems simple enough. However, the truck and its operator frequently have made previous stops in other feed lots. Particularly in the raising of hogs, that fact creates disease problems. Many diseases—particularly of hogs, but also of other livestock—are carried through contaminated soil, manure and the like which may cling to the truck operator's boots, to other clothing to truck tires. Therefore, it is not good practice to allow either the truck or the driver into the feed lot.

One of the reasons—and often the only reason—for a driver to enter the lot is to open the bin. This is true whether or not the cap can be removed from the ground. Thus, unless the owner of the livestock is available to open the bin, there is a danger of carrying disease from one lot to another.

By my invention, I provide a cover for the bin which can be operated easily and mechanically from a truck outside the feed lot, completely removing any need for any one to enter the lot. Thus, the truck operator can open the cover, avoiding a need to call the livestock producer away from other activities and at the same time not requiring the entry into the lot of any one who might have had contact with livestock at other locations.

DESCRIPTION

Figure 1:
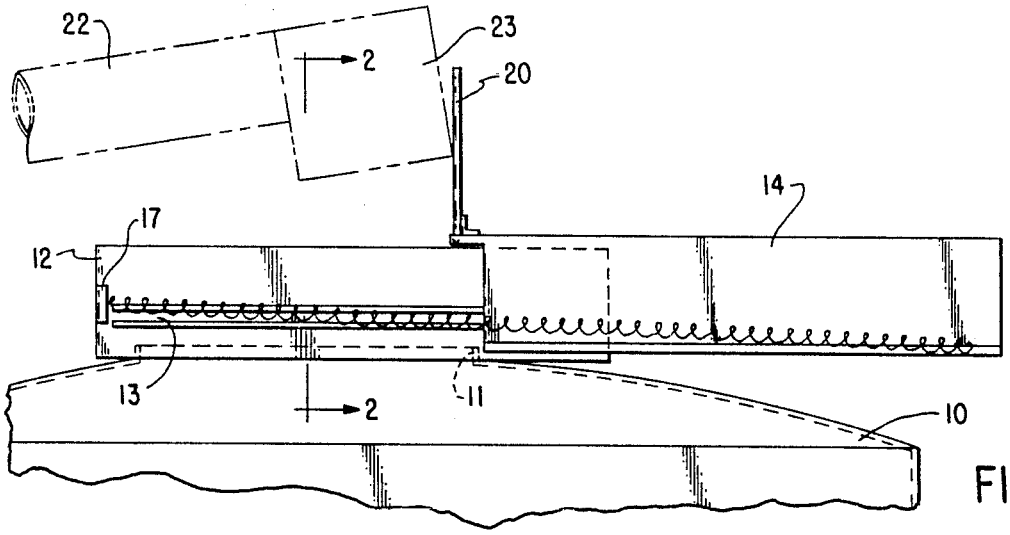
FIG. 1 is a side elevational view of the closure device mounted on a bin, showing the closure in an open position.

Briefly my invention comprises a closure for the top opening of a bin or bin-type feeder which can be opened by the spout of the elevator on a delivery truck. The closure is biased to a closed position and includes a safety notice to notify an operator when the openng is fully available for delivery.

More specifically and referring to the drawings, I envision my device being used in connection with a bin 10 which may be a part of a livestock feeder. Commonly, these bins are filled from the top through an opening 11. These openings are usually covered with a simple cap which can be removed manually, or occasionally a cap is hinged to the bin and is tilted to open the bin. My device is adapted to replace or to modify such a cap. To do that, I fasten a rectangular, box-shaped collar 12 to the bin 10 surrounding the opening 11. It will be apparent that if it were desired to keep the hinged cap, an opening in that cap could be made and the cap retained in place. In either case, the rectangular collar 12 would be installed similarly.

Figure 2:
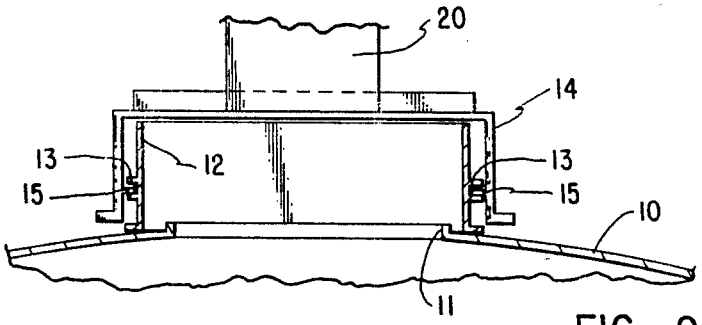
FIG. 2 is a partial sectional view from line 2—2 of FIG. 1.
Figure 3:
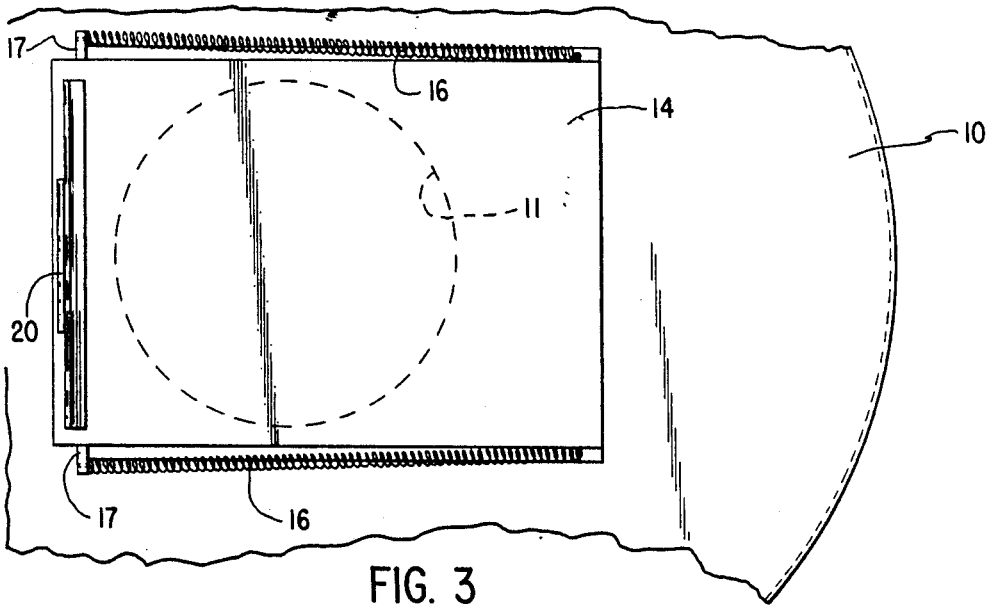
FIG. 3 is a top plan view of the closure device in a closed position.
Figure 4:
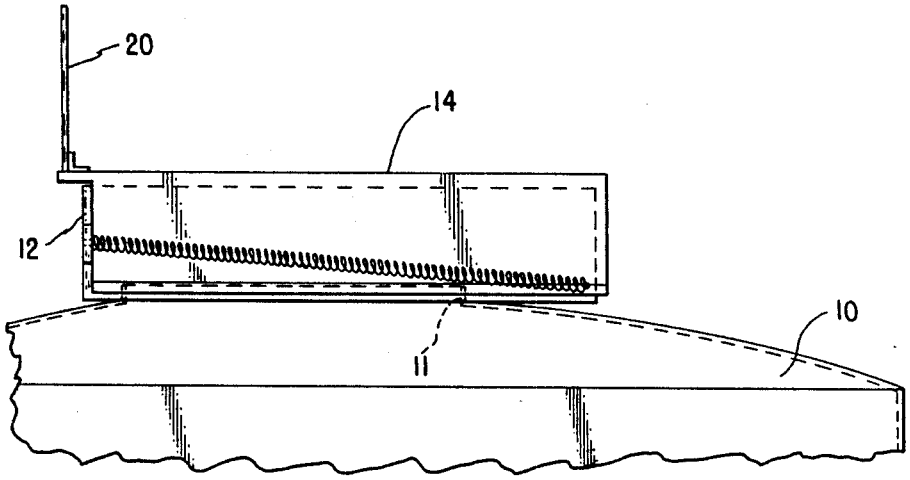
FIG. 4 is a side elevational view of the closure mounted on a bin.
Figure 5:
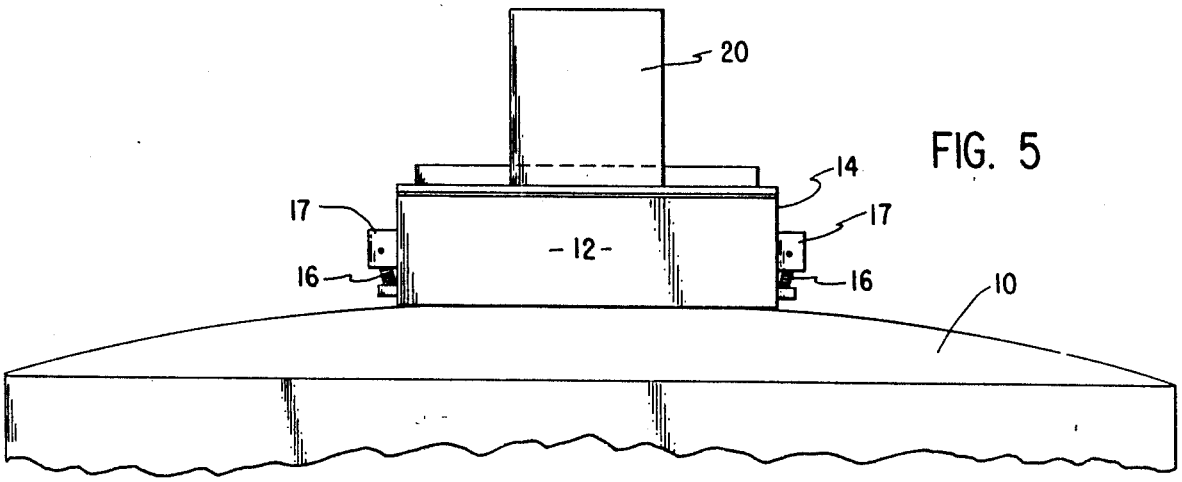
FIG. 5 is a front elevational view of the closure of FIG. 4.

On opposite sides of the collar 12 there are two flanges defining a slide 13. The cover 14 is also rectangular, and includes a top and three sides. Thus, the cover is formed as a 3-sided, inverted box. On each of the two sides corresponding to the slides 13, I provide a flange 15 to slide in the slide or channel 13 (See FIG. 2). Thus, the cover 14, which overhangs the collar 12 on all sides is adapted to cover he opening 11 and can be slidably removed from the opening by moving the cover 12 and its flange 15 slidably relative to the channel 13.

In order to bias the cover to a closed position, the preferred means includes a pair of tension springs 16 engaged between ears 17 on the collar 12 and the cover 14. These springs 16 are stretched when the closure 14 is slid open, and then will return the closure to the closed position when the opening force is withdrawn.

Opening of the closure is accomplished by means principally illustrated in FIG. 1. A target plate 20 is fixed to the edge of the cover 14 and stands erect from that edge. The plate 20 must be stiff enough and large enough that it can be engaged and pushed by an external means to slide open the closure 14. I have also discovered that the edge of the cover 14 is the most effective place for the plate 20. Anything other than that seems to distort the view of the operator.

At present, it is envisioned that a delivery truck having an auger-type delivery tube 22 will be used. The spout end 23 on that tube can be directed to contact the plate 20 as shown in FIG. 1. Movement of that spout either by movement of the truck or extension of the elevator by other means can then be used to slide open the cover. Feed can then be delivered by the elevator and spout into the bin. After the required amount of feed is delivered, the elevator can be removed and the cover 14 will be returned to the closed position over the opening 11 by the springs 16.

Figure 6:
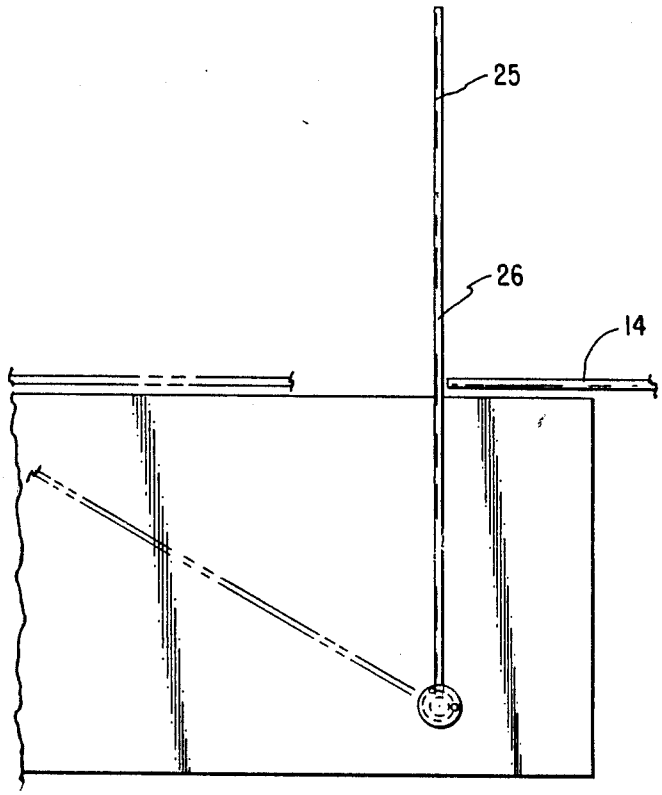
FIG. 6 is a detailed side view to an enlarged scale of a warning device used in connection with the closure.
Figure 7:
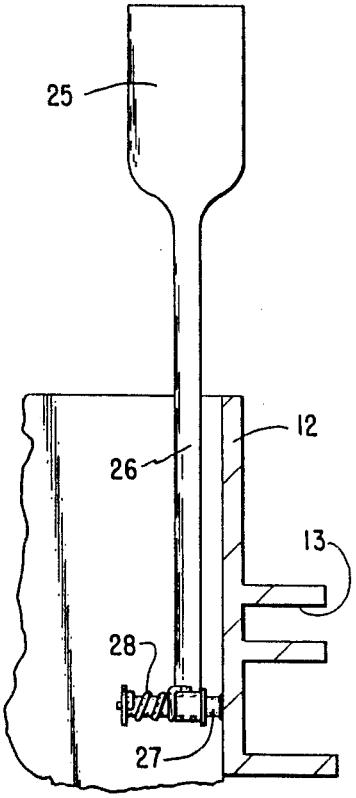
FIG. 7 is a front view of the device illustrated in FIG. 6.

In order to avoid pushing the cover farther than desired, I provide a flagging device. Although I prefer to construct the closure device so that too much movement will result only in pushing the cover out of its tracks rather than providing positive stops, it is still desirable to avoid pushing beyond certain limits. Therefore, the flagging device is desirable to warn the operator before the limit is reached. This device is illustrated in FIGS. 6 and 7.

The flagging device consists principally of a stiff—preferably metal or permanent plastic—flat 25 and stem 26. The stem is pivotally journalled on a pin 27 fixed to the collar 12. A coil spring 28 surrounding the pin 27 is arranged to bias the flag 25 and stem 26 to an upright position. However, when the cover 14 is closed, the flag 25 is pressed by the cover to a lowered position shown by the dashed lines in FIG. 6.

Thus, when the cover 14 is closed, the flag 25 is in the lowered position with the flag pressing the underside of the cover under urging of the spring 28. As the cover 14 is moved by the elevator 22 to its open position, it soon begins to release the flag. Further movement will allow the flag 25 to rise to a position where it will be easily seen by the operator of the truck. At that point, the operator is warned by the flag that the cover has been moved far enough to allow the feed to be run into the bin. Thus, the flag provides a warning which will help to avoid sliding the cover out of its tracks, and provide considerably easier operation of the device.

I claim as my invention:

1. In combination with a bin having a top opening and adapted to hold livestock feed and to be filled by an elevator means on a truck, closure means adapted to cover said opening including a collar surrounding said opening and attached to said bin, cover means slidably mounted on said collar, said cover means having a front portion at the end which first exposes said opening, plate means extending upwardly from said front portion a distance suitable to be engaged by said elevator on said truck whereby movement of said elevator will cause said cover means to slidably expose said opening.

2. The closure means of claim 1 in which biasing means is engaged between said collar and said cover means to bias said cover means to a closed position.

3. The closure means of claim 2 in which warning means is mounted on said collar, said warning means being controlled by the position of said cover means whereby a warning is made when said cover means reaches its open position.

4. The closure means of claim 1 in which said collar is rectangular in plan form, said collar being formed to provide a channel on each of two opposite sides, said cover means including flanges slidably disposed in said channels whereby said cover is slidable relative to said collar.

5. The closure means of claim 3 in which said warning means includes a stem means pivotally mounted on said collar, a flag on said stem means adapted to extend well above said collar in an upright position, spring means engaged between said collar and said stem means to bias said stem means to an upright position, said cover means being adapted to press and hold said stem means in a lower position when said cover means is closed.

* * * * *